United States Patent [19]

Schulte et al.

[11] 4,021,187

[45] May 3, 1977

[54] AUTOMATIC FLUE GATE

[75] Inventors: Milton Robert Schulte; George Albert Swartz, both of Quakertown, Pa.

[73] Assignee: Thermal Developments, Inc., Quakertown, Pa.

[22] Filed: Aug. 15, 1975

[21] Appl. No.: 604,904

[52] U.S. Cl. ..... 431/20; 126/285 B; 236/16

[51] Int. Cl.[2] ..... F23N 3/00; F23N 3/02

[58] Field of Search ..... 431/20; 126/285 R, 285 B, 126/286; 236/16, 45; 251/130; 110/163

[56] References Cited

UNITED STATES PATENTS

| | | | |
|---|---|---|---|
| 2,166,242 | 7/1939 | Doolittle | 236/16 |
| 2,179,120 | 11/1939 | Firehammer | 126/285 B |
| 2,224,705 | 12/1940 | Stringer | 126/285 B |
| 2,357,642 | 9/1944 | Firehammer | 236/45 |

*Primary Examiner*—Carlton R. Croyle
*Assistant Examiner*—Louis J. Casaregola
*Attorney, Agent, or Firm*—Edward R. Weingram

[57] ABSTRACT

A flue gate device operated by a solenoid whose energy comes from any outside source, which energy is controlled by the furnace burner control of the furnace to which it is attached. The pull of the solenoid is resisted by a spring which will restore the flue gate to an open position when the solenoid is deenergized or in case of an electrical failure in the flue gate device itself. Through relay switches, the solenoid is deenergized when the furnace burner is energized, and the solenoid is energized when the burner is deenergized, thus enabling a "fail-safe" condition, which enables the furnace to function completely free of the flue gate device.

9 Claims, 7 Drawing Figures

AUTOMATIC FLUE GATE

BACKGROUND OF THE INVENTION

This invention relates in general to an electrical operating apparatus for gates or dampers in the exhaust or chimney flues of oil fired or gas fired heaters for closing the damper when no combustion is taking place to prevent the escape up the chimney flue of air previously heated, thus to alleviate the present energy crisis by conserving gas and fuel oils. Examples of such automatic dampers are found in U.S. Pats. Nos. 2,218,061, 2,224,705, 3,580,238 and 2,166,242. Obviously, such apparatus also provide that the damper shall be in flue-opening position immediately prior to and during the combustion of the fuel.

In known apparatus such as exemplified by U.S. Pat. No. 3,580,238 the electrical control for the damper operating mechanism and the electrical control for the heater, are so connected in circuit that failure of either the damper control or the heater control will detrimentally affect the other.

Furthermore, the prior devices leave much to be desired in that they are dangerous to use, complicated or too expensive, or are not readily adaptable to installation in existing fuel gas and fuel oil heating systems.

SUMMARY OF THE INVENTION

A primary object of the invention is to provide an automatic damper for controlling the flow through an exhaust or chimney flue of a combustion apparatus which overcomes the objections to and disadvantages of prior devices, and which is simple in construction and safe and dependable in operation and is capable of being easily and quickly installed in existing fuel gas or fuel oil heating systems as well as desirable for use in new installations.

Another object is to provide a device which, while responsive to the action of the heating system, is, nevertheless, completely free and independent of the electrical control system which forms a part of known or existing heating systems, for example, electrically operated oil burners.

Yet another object of the invention is to provide a trustworthy, dependable device of this character which in case of electrical failure within itself or failure in its source of supply of electricity will not cause the heater burner to cease its operation, thus protecting the premises if left unoccupied for a number of days in severely cold weather from freezing of the water pipes.

It is a further object of the invention to provide a device of this character which will respond to an electrical failure within itself or from an external main source, by restoring the damper to a safe, harmless open position that will ensure no obstruction to free exhaust flow of poisonous or noxious combustion gases through the flue in which the damper is installed.

The invention also includes a damper plate or gate rotatably mounted transversely of a smoke pipe or flue which embodies a novel and improved construction that permits adjustment so as to ensure a predetermined minor flow or seepage of gas through the plate and thereby allow removal of possibly toxic and noxious fumes or gases formed in the combustion chambers of standby ignition devices, such as pilot flames in a fuel gas combustion system.

Other objects, advantages and results of the invention will appear from the following description in conjunction with the following drawings.

BRIEF DESCRIPTION OF THE DRAWINGS

Referring to the accompanying drawings.

DESCRIPTION OF THE PREFERRED EMBODIMENT

Figures 1, 4, 5, 6, 7:
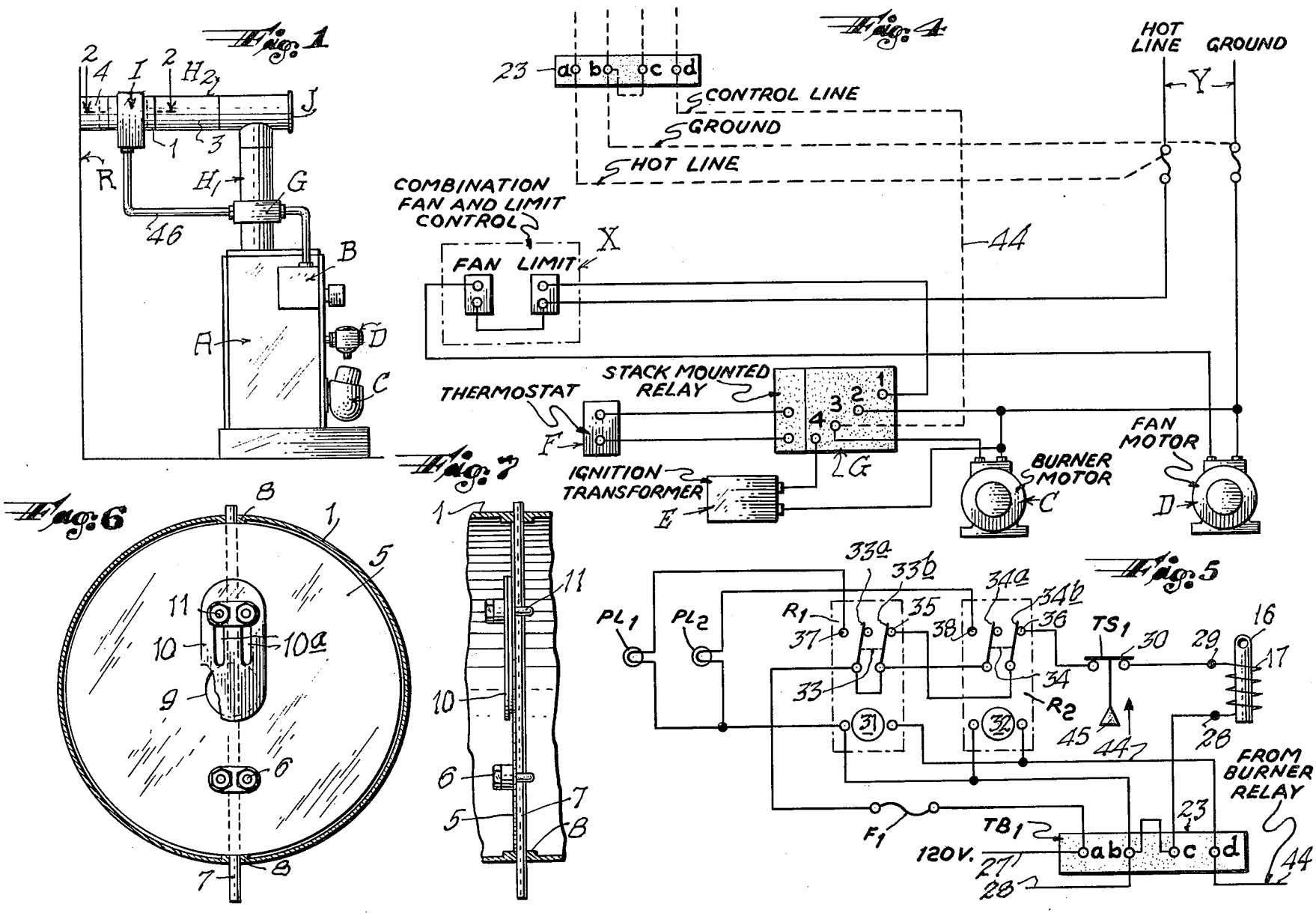
FIG. 1 is a side elevational view of our automatic flue gate installed in an oil burner heating furnace of known type.
FIG. 4 is a schematic circuit diagram of a known oil burner control circuit.
FIG. 5 is a similar view of the automatic gate control circuit embodying the invention.
FIG. 6 is a transverse sectional view of the smoke pipe section, showing the damper plate in front elevation.
FIG. 7 is a vertical, longitudinal, sectional view on the plane of line 7—7 of FIG. 6, with the damper plate shown in side or edge elevation.

For the purpose of explaining the invention, it is shown in connecting with a generally known type of residence heater including the usual furnace A having a combustion chamber in which may be a gas-fired or oil-fired burner (not shown) controlled by the usual known type of control apparatus enclosed in a casing B mounted on the furnace housing. For illustrative purposes, we have associated the invention with a known type of oil burner system which, as schematically shown in FIG. 4, includes a burner motor C, a fan motor D, a transformer E for an ignition device not shown, a thermostat F located in the space to be heated, and a stack mounted relay G usually mounted in the exhaust passage of the combustion chamber.

The furnace has the usual smoke pipe H for the exhaust of the gases of combustion from the combustion chamber, said smoke pipe being shown with a vertical portion $H_1$ and a horizontal portion $H_2$. The automatic flue gate apparatus I of the invention can be adapted to be connected to any of various exhaust or outlet ducts of different types of heaters or furnaces, and here is shown as including a pipe section 1 which can be installed wherever its axis will be coincidental with the axis of the existing pipe. Here it is shown as embodied in the horizontal portion of the smokepipe and the pipe section 1 has one end tapered at 2 to telescopically fit into one section 3 of the smoke pipe and its other end to telescope over the end of another section 4 which is connected to the chimney R of a house in known manner.

Normally, the smoke pipe H has, as part of its assembly, a device known as an automatic draft regulator which can have one of several known forms and is always located between the combustion system and the chimney R. This device is intended to be preadjusted in such a way as to provide more or less continuous flow of air from the building surrounding the heating system, and be drawn into the smoke pipe and upwards through the chimney in order to satisfy the varying amounts of negative pressure created in the chimney by wind and other weather conditions. It is also intended that this device be preadjusted to provide a rather precise control of negative pressures or draft in the firebox or combustion chamber of the furnace so as to provide the most efficient use of the fuel being used during the combustion cycle. The automatic draft regulator is shown in FIG. 1 and indicated by reference character J, with an automatic flue gate apparatus I embodying the invention properly installed between it and the chimney. It is therefore possible to have the draft regulating device perform its intended function only during periods of actual fuel combustion with the automatic flue gate stopping the wasteful flow of heated air during periods of noncombustion.

Figure 2:
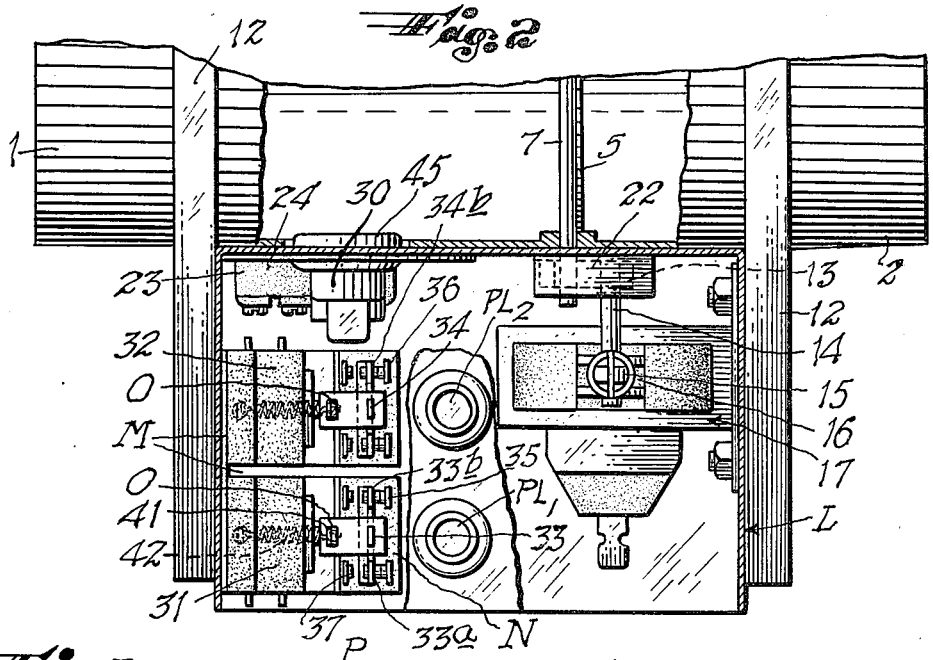
FIG. 2 is a fragmentary top plan view of the smoke pipe section of the flue and the control box with portions broken away approximately on the plane of the line 2—2 of FIG. 1.

The flue gate apparatus of the invention includes a circular damper plate 5 of a diameter slightly less than the diameter of the pipe section 1 and mounted in the pipe by being rigidly connected by U-bolt fasteners 6 to a diametrical pivot rod 7 which has its ends rotatably or pivotally journaled in bearings 8 disposed diametrically opposite in the pipe one of which bearings is shown in FIG. 2 and both of which appear in FIG. 7. The damper is closed when the plate 5 is disposed concentrically with the axis of the pipe so as to practically cut off flow of gas through the pipe as shown in the drawings, and the damper is fully open to permit free flow through the pipe when the plate lies in an axial plane of the pipe. When the damper is closed, it may be desirable to provide additional and adjustable passage for gas past the damper plate 5 to permit escape of gases formed in the combustion chamber, for example, by standby ignition devices such as pilot flames in a fuel gas combustion system. For example, the plate may have a central opening 9 and the damper may have a valve plate 10 adjustably mounted thereon by a fastener comprising a U-bolt 11 straddling the pivot rod and whose legs pass through holes in the damper plate and through slots in the valve plate and have nuts to clamp the valve plate on the damper plate so that the valve plate may be positioned to entirely close the opening 9, as shown in FIGS. 6 and 7, or may be slidably adjusted on the damper plate to partially open said opening to vary the size of the passage for gases.

The automatic flue gate or damper of the invention is electrically operated and controlled by apparatus which is fail-safe that is ensures that the damper shall always be fully open when combustion takes place.

One important feature is that the control apparatus for the automatic flue gate, while responsive to the operation of the heating system, nevertheless is free and independent of the electrical control system that is normally a part of the heating system that includes an oil burner or a gas burner.

Another important feature is that the apparatus will respond to an electrical failure within itself or from an external main current supply by restoring itself to a harmless open position.

Figure 3:
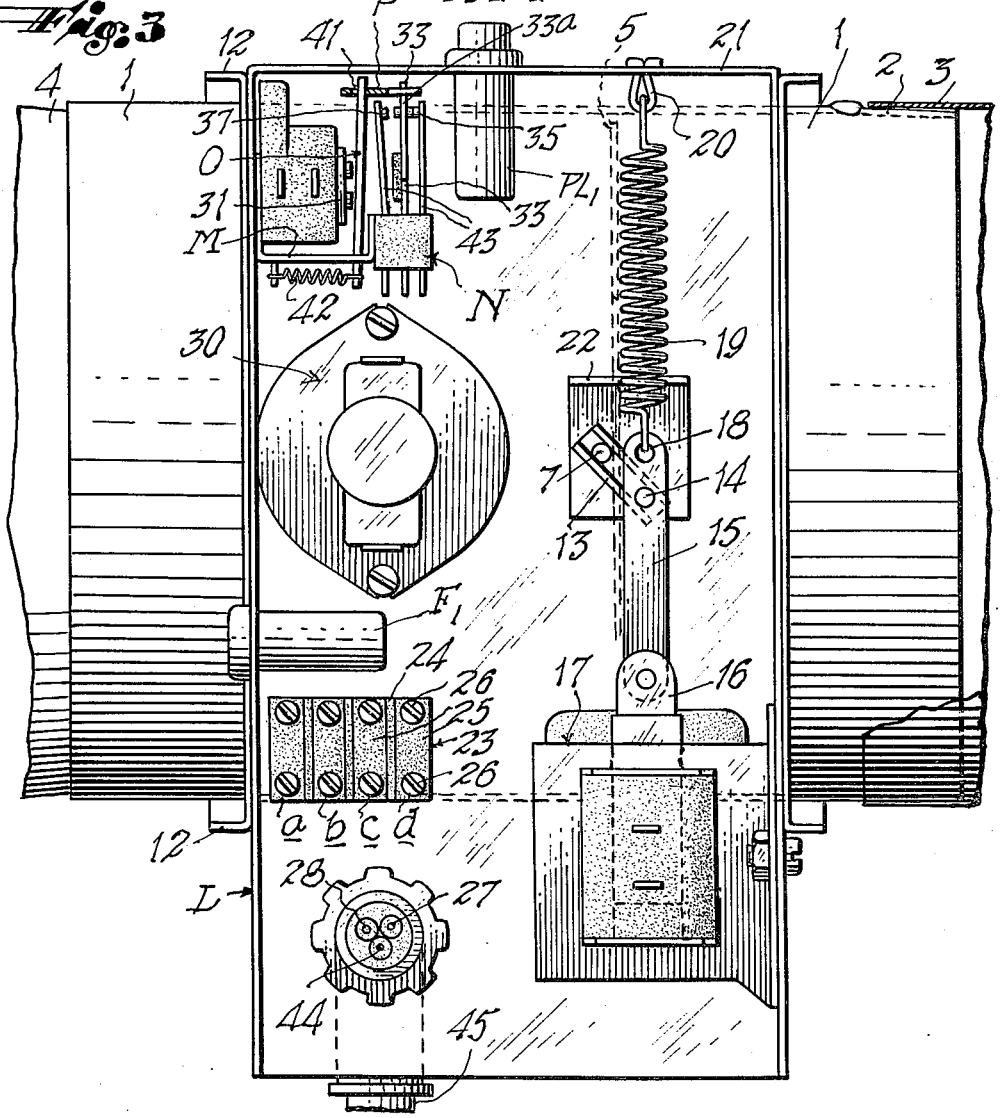
FIG. 3 is a front elevation view of the automatic gate control apparatus, with the front cover of the control box removed and with some circuit wires omitted.

In the now preferred embodiment of the invention, the actuating and control apparatus for the damper plate 5 is enclosed in a box L mounted by brackets 12 on the pipe section 1 in any desired convenient position in a 360° arc about the axis of the portion $H_2$ of the smoke pipe. One end of the damper pivot rod or shaft 7 projects from the pipe section 1 into said control box and has rigidly connected thereto one end of a crank arm 13 the other end of which is pivotally connected by a pin 14 to a link 15 which in turn is pivotally connected to the armature or plunger 16 of a solenoid assembly 17. The armature is connected at 18 to one end of a tension spring 19, the other end of which is connected by a loop 20 to a fixed support, here shown as top wall 21 of the control box. When the solenoid is deenergized, the spring biases the damper plate into open position and the armature 16 to an upper position, and when the solenoid is energized, the armature is magnetically drawn downwardly against the influence of the spring to actuate the damper plate into closed position as shown in FIGS. 2 and 3. To limit the upward movement of the armature and at the same time to stop rotation of the damper plate in the full open position, a stop bracket 22 is secured to the rear wall of the control box to be abutted by the crank arm and limit upward swinging of the crank arm.

Mounted on the back wall of the control box is a terminal block 23 of known construction including a base 24 of insulating material and conducting terminal strips 25 of which there are four, respectively denoted *a*, *b*, *c* and *d* with associated terminal screws 26. This block is illustrated schematically in the circuit diagram shown in FIG. 5. To the terminal denoted *a* is connected one side 27 of a 120 volt supply line. Terminals *b* and *c* are electrically connected together, and a common neutral ground wire 28 is also connected to terminal *b*. Terminal *c* is connected to one terminal 28 of the winding of the solenoid the other terminal 29 of which is connected to one terminal of a known type of thermally actuated time delay switch 30, the purpose of which is to delay the operation of the solenoid assembly to ensure a "post combustion purge" allowing air to be drawn through the combustion chamber after the flame has been extinguished a predetermined period of time.

The time delay switch is electrically connected in circuit with two identical relay switches denoted $R_1$ and $R_2$ respectively which are connected in parallel circuit and to the 120 volt supply at terminal *a*. The 120 volt line extending between terminal *a* and relay switches $R_1$ and $R_2$ is provided with a suitable fusable connection denoted $F_1$ to protect the primary supply source from interruption due to a component failure within the automatic flue gate circuit. The solenoids of the relay switches are denoted respectively 31 and 32 and each solenoid has two terminals which are connected respectively to the terminals *b* and *d* of the terminal block 23.

FIGS. 2 and 3 schematically illustrate the switch structures, and FIG. 5 is a wiring diagram of the circuit for the automatic flue gate control apparatus. The solenoids 31 and 32 are fixedly mounted by a bracket M on a wall of the control box L and the switches $R_1$ and $R_2$ include the respective resiliently flexible double contact arms 33 and 34 mounted at one end on an insulating block N secured on the bracket M. The contact arm of each switch is actuated or flexed in one direction to close the circuit through the solenoid 17 by an armature 0 pivoted intermediate its ends on the bracket M and carrying at its upper end a coupling plate P which has a slot 41 through which loosely extends the corresponding contact arm. The armature is actuated in the opposite direction by a tension spring 42 connected between the lower end of the armature and the bracket. Each contact arm has contact fingers insulated from each other to coact with fixed contacts which are mounted on supports 43 that have limited inherent resiliency and are secured at one end on the insulating block N. The contact fingers 33*a* and 33*b* of the contact arm 33 are insulated from the arm and have their mounting ends electrically connected together and to the 120 volt line at terminal *b* of the terminal block 23 and the mounting end of contact finger 33*b* is electrically connected to the mounting end of the contact finger 34*a*. The swinging end of the finger 33*b* coacts with a contact 35 which is electrically connected to the mounting end of the contact finger 34*b* of the contact arm 34 the swinging end of which coacts with a contact 36 which is connected to one terminal of the thermally actuated delay switch 30 the other terminal of which is connected to one terminal 29 of the winding of the solenoid 17 whose other terminal 28 is connected to the terminal *c* of the terminal block. The swinging ends of the contact fingers 33*a* and 34*a* coact respectively with contacts 37 and 38. The contact 37 is connected to one terminal of a pilot lamp $PL_1$ while the contact 38 is connected to one terminal of a pilot lamp $PL_2$. The other terminals of said lamps are connected to the terminal *b* of the terminal block 23. The contacts 35 and 36 are normally closed to energize the solenoid 17, and the contacts 37 and 38 are normally open to deenergize the pilot lamps.

In order to provide sequential operation of the damper plate 5 with the operation of the oil burner, the terminal *d* of the terminal block 23 is connected to the burner relay as by a wire 44 shown in dotted lines in FIG. 4 which is intended to illustrate an oil burner system associated with our control apparatus for the damper 5, the circuit connections between the damper control apparatus and the oil burner system being indicated by broken lines. and by cable 46 in FIG. 1.

The oil burner system is well known and is schematically shown in FIG. 4 with parts omitted such as the ignition mechanism, and the fuel oil supply mechanism. In the interest of simplicity, we have shown the system as including the usual electric motor C, fan motor D, stack mounted relay G, ignition transformer E, room thermostat F, and a combination fan and limit control X. These parts are connected in the usual manner in circuit with an electrical supply line generally designated Y.

The operation of the automatic flue gate apparatus will be understood from the following description. While the burner is not running, the solenoid assembly 17 is energized which moves its armature 16 to its closed position, which through linkage 15 will put spring 19 into tension and operate the crank arm 13 which will bias damper plate 5 to its closed position. This is accomplished by getting its electric current from any convenient source, through a switch actuated by a relay, whose armature coil is energized by the same source of electricity as the fuel burning apparatus. Here there are two relay switches $R_1$ and $R_2$ wired in parallel circuit. The solenoid 17 when energized, receives its current through the "normally closed" contacts of the relay switches. It can be readily seen from FIG. 5 that the armature coils of relay $R_1$ and $R_2$, being wired "parallel" to each other will then simultaneously receive power from the fuel combustion system. When these armature coils are energized, the associated contact arms will then change the flow of current through them, i.e., the normally closed contacts become "open" contacts and the normally open contacts become "closed." When the associated solenoid coil is deenergized, the current flows through the movable contact to one of the stationary contacts (this is the normally closed position). When the solenoid coil is energized, the electromagnetic force thus created on the armature moves the armature to which is attached the movable contact arm. This movement then causes the current flow to stop through the normally closed stationary contact and be routed through the opposite stationary contact (known as the normally open contact). Thus it can be seen that by having two sets of these contacts, that upon activation of the solenoid coil of a relay, the current flow can be switched from solenoid 17 and diverted to an associated signal light. Therefore, a visual signal is provided to allow the dwelling owner to see at a glance if one or both relay switches are properly functioning.

It can then be seen from FIG. 5 that when the armature coils of relays $R_1$ and $R_2$ are energized, the flow of current from terminal *a* through $R_1$ and $R_2$ reaching solenoid 17 has now been interrupted so that solenoid 17 releases its electro-magnetic force on armature 16 and allows coil spring 19 to apply to linkage 15 and crank arm 13 the energy previously stored in it. The movement thus created by application of this stored energy will therefore be applied to shaft 7 via crank arm 13 and will cause damper plate 5 to rotate 90° about its axis and reach an open position within the flue pipe to allow complete egress of the products of combustion at the moment combustion begins.

The moment combustion ceases, relay $R_1$ and $R_2$ become deenergized and the current is switched back to solenoid 17 which in turn causes damper 5 to return to its closed position in the flue pipe. If this were to occur too rapidly, the remaining noxious gases and products of combustion would not be able to be completely removed from the furnace. Therefore, a "post purge" period must be incorporated into the function of the automatic flue gate device. This time delay feature is accomplished by incorporating the thermally actuated, normally closed relay located between relay $R_2$ and solenoid 17 and designated as $TS_1$ in FIG. 5. The following is a description of the function of this device. A heat-sink 45 is located so that it slightly protrudes into the flue pipe so that when the furnace combustion apparatus is in operation and the automatic flue gate is open, the waste heat traveling out the flue will heat up this heat-sink. A heat sensitive linkage attached to the heat sink will then expand and snap open a contact which will then open the electrical circuit between relay $R_2$ and solenoid 17. As long as sufficient heat remains stored in the heat sink the switch contacts will remain open. It can therefore be seen, that as soon as combustion ceases in the furnace, relay $R_1$ and $R_2$ solenoid coils become deenergized, the contacts in each relay return to a normally closed position, the signal lights $Pl_1$ and $Pl_2$ shut off, but the residual heat traveling up the flue keeps thermal switch $TS_1$ open, keeping solenoid 17 deenergized and flue gate 5 open until the residual heated products of combustion have been removed from the fire box. As the heat sink of the thermal switch cools down to a preset point, the switch contacts can then move back to a normally closed position allowing current to flow to solenoid 17, energizing it, causing movement of armature 16 moving linkage 15, crankarm 13, turning shaft 7, biasing damper plate 5 to a closed position in flue pipe.

It will also be noted that because of the "series - parallel" wiring arrangement of relays $R_1$ and $R_2$, that a failure of operation of either relay $R_1$ or $R_2$ would not stop proper functioning of the automatic flue gate upon signal of start of the fuel combustion process. The normal failure mode of electromagnetic devices is a failure of the electrical coil which produces the magnetic field about the armature of the device. However, these electro-magnetic devices were chosen for use in the automatic flue gate because of their long and proven record of being able to function for many thousands of cycles without failure.

It therefore can be clearly seen from the previous description that there are several "fail safe" characteristics which have been carefully included in design of the automatic flue gate. These fail safe characteristics are as follows:

1. If the solenoid coil 17 fails or burns out or short circuits, circuit fuse $F_1$ burns out, causing indicating lights $Pl_1$ and $Pl_2$ not to light regardless of the action of relay switches $R_1$ and $R_2$; however, at the moment of failure of solenoid coil 17, the electro-magnetic force holding the armature 16 is released, allowing spring 19 to apply its stored energy to move linkage 15 and crankarm 13 and shaft 7 to rotate damper 5 90° to the full-open position within the flue pipe. Damper 5 will continue to stay full-open for an indefinite period of time and will in no way interfere with normal operation of the fuel combustion system with the only loss being that of fuel saving by not stopping the wasteful loss of heated air from the building being drawn up the chimney. A periodic visual examination by the dwelling owner would readily indicate this malfunction since neither signal light $Pl_1$ or $Pl_2$ would light during any heating cycle.

2. By supplying duplicate relays $R_1$ and $R_2$, it can be seen that if an electrical failure were to take place in the solenoid coil of either $R_1$ or $R_2$ for and previously stated reason, the remaining one would still function. Because the main power to operate solenoid 17 is supplied by a series connection through relays $R_1$ and $R_2$, either one functioning would have the same effect as both relays functioning; i.e., stopping flow of power to solenoid 17 and allowing spring 19 to apply its stored energy to move linkage 15 and crank arm 13 and shaft 7 to rotate damper 5 90° to the full open position within the flue pipe. It will be noted that operation of either relay $R_1$ or $R_2$ will light its associated signal light $Pl_1$ or $Pl_2$, thereby giving the dwelling owner a visual indication of a component failure. Also, if a dwelling owner were going to leave the premises unattended for some period of time in cold weather, he would need only to make a visual check to see if both signal lights were lit and could be reasonably confident that the automatic flue gate would operate during his absence, because the chance of both relay $R_1$ and $R_2$ failing together is nil. However, if the dwelling were to be left unattended for an extended time, fuse $F_1$ need only to be removed from its holder; solenoid 17 would remain continuously deenergized and the damper would remain in its full open position continuously.

3. The third failure that could occur would be where the dwelling owner provided no attention to the automatic flue gate over a long period of time, and during that period both relays $R_1$ and $R_2$ ceased to function and the fuel combustion system went into operation. The damper plate of the flue gate would be still in its closed position and combustion proceeds. A very smoky fire would be produced and within about 90 seconds there would be a complete shut-down of the combustion system with a "lock-out" feature which will take over. This lock-out feature is a built in part of all combustion systems and is required by regulatory agencies having jurisdiction, such as Fire Underwriters. The combustion system cannot restart until the control device lock-out switch is manually reset. This failure mode is the least likely to occur in that relay switches are a device of proven reliability.

4. The fourth type of failure mode which could occur, would be in case solenoid 17 receives its electrical current from a remote source not necessarily related to that power supplied to operate the fuel combustion equipment, a failure in that source of supply would merely cause solenoid 17 to become deenergized and allow spring 19 to release its stored energy to move linkage 15 and crank arm 13 and shaft 7 to rotate damper 5 90° to the full open position in the flue pipe. The combustion equipment could continue to operate unhindered by the automatic flue gate until full power is restored.

From the foregoing, it will be understood that because of these previously described components and their unique arrangement and utilization within the automatic flue gate device, it is possible to have a truly fail-safe control mechanism that ensures a fuel saving, absolutely trustworthy, longlived and dependable flue gate operating apparatus.

While the now-preferred embodiment of invention has been illustrated and described, it will be understood by those skilled in the art that modifications and changes in the construction and use of the invention can be made within the spirit and scope of the invention as defined in the appended claims.

We claim:

1. An automatic flue gate apparatus for installation in the outlet flue of a furnace that includes an electrically operated burner and an electric control for said burner connected to a first source of electricity and operative to actuate said burner, said flue gate apparatus comprising a gate movable between a flue-opening and a flue-closing position, means biasing said flue gate into flue-opening position, electrically operated actuating means for actuating the flue gate into flue-closing position when said actuating means are supplied with electric current from a second source of electricity, electric control mechanism operative to shut off electric current supply to said electrically operated actuating means, and an activating device for said electric control mechanism energized by electric current from said electric control for the burner so that the flue gate is normally actuated into flue-closing position but is automatically biased into flue-opening position upon energization of said activating device for said electric control mechanism by electric current from said electric control for the burner, thereby to ensure that normal electrical failure in said control mechanism will permit said flue gate to be biased open and will not interfere with the functioning of the burner.

2. An automatic flue gate apparatus as defined in claim 1 wherein said electrically operated actuating means includes a main electric solenoid receiving its energy from a source outside the electric burner control through a relay switch whose coil is energized by an electric current from the burner conrol.

3. An automatic flue gate apparatus as defined in claim 2 wherein there are two relay switches connected in series and activated by coils that are connected in parallel so that failure of either relay switch will not affect the other.

4. An automatic flue gate apparatus as defined in claim 2 with the addition of two signal lights each controlled by one relay switch providing a visual check of operation or failure of the circuit through the corresponding switch.

5. An automatic flue gate apparatus as defined in claim 2 with the addition of a thermal relay switch located so as to be responsive to the heat of combustion and connected in circuit with said main electric solenoid so that the solenoid's energy passes through said thermal relay switch which will break and hold open the circuit a period of time sufficient to allow purging of the furnace and flue of residual combustion gases.

6. An automatic flue gate apparatus as defined in claim 2 wherein said main electric solenoid has an armature and with the addition of means connecting said armature to said flue gate to move the flue gate into flue-closing position upon energization of said solenoid, said means including a tension spring to bias said flue gate into flue-opening position when said solenoid is deenergized.

7. The automatic flue gate apparatus as defined in claim 1 wherein said flue gate has a seepage orifice and means for adjusting the size of said orifice, including a plate adjustably mounted on said flue gate selectively to partially or completely overlie said orifice.

8. A flue gate apparatus including an open ended pipe adapted to be installed as a portion of an exhaust smoke pipe, a flue gate plate pivotally mounted in said open ended pipe for movement selectively into open position and closed position, an electric control mechanism for actuation of said flue gate plate including a main electrical solenoid having an armature connected to said flue gate plate for actuating said flue gate plate into closed position upon energization of said solenoid, a spring connected to said armature and said flue gate plate to actuate said flue gate plate into open position upon deenergization of said solenoid, means for connecting said solenoid to a source of electricity, through a relay switch, and means for connecting the coil of said relay switch to the electrical control of an electrically operated burner, whereby the flue gate plate will be operated in timed relation to the operation of such a burner and normal electrical failure within said control mechanism will not interfere with the electrical controls of the burner.

9. An automatic flue gate apparatus for installation in the outlet flue of a furnace that includes an electrically operated burner and an electric control for said burner connected to a first source of electricity and operative to actuate said burner, said flue gate apparatus comprising a gate movable between a flue-opening and a flue-closing position, means biasing said flue gate into flue-opening position, electrically operated actuating means for actuating the flue gate into flue-closing position when said actuating means are supplied with electric current from a second source of electricity and control mechanism therefor including a switch operative to shut off electric current supply to said electrically operated actuating means so as to deenergize said electrically operated actuating means, said control mechanism including an activating device for said switch adapted to be connected to said electric control of the burner and activated therewith so that said flue gate is normally actuated into flue-closing position while the burner is at rest and is biased into flue-opening position upon energization of said activating device by an electric current from the electric burner control, thereby to ensure that normal electrical failure within said control mechanism will permit said flue gate to be biased open and will not interfere with the functioning of the burner.

* * * * *